US006321396B1

(12) United States Patent
Vallejo

(10) Patent No.: US 6,321,396 B1
(45) Date of Patent: Nov. 27, 2001

(54) SYSTEM FOR ADAPTING A TOILET FOR USE AS A BIDET

(76) Inventor: Gualberto Vallejo, 7 Ascan St., Valley Stream, NY (US) 11580

( * ) Notice: Subject to any disclaimer, the term of this patent is extended or adjusted under 35 U.S.C. 154(b) by 0 days.

(21) Appl. No.: 09/663,174

(22) Filed: Sep. 15, 2000

Related U.S. Application Data

(66) Substitute for application No. 09/082,675 on May 21, 1998.

(51) Int. Cl.[7] ..... A47K 3/26
(52) U.S. Cl. ..... 4/420.2; 4/447
(58) Field of Search ..... 4/420.2, 420.4, 4/420.5, 447, 448

(56) References Cited

U.S. PATENT DOCUMENTS

| | | | | |
|---|---|---|---|---|
| D. 355,246 | | 2/1995 | Kawamura et al. . | |
| 821,259 | * | 5/1906 | Roux | 4/448 X |
| 2,875,450 | | 3/1959 | Umann . | |
| 4,127,904 | | 12/1978 | Junker . | |
| 4,145,767 | | 3/1979 | Ibel . | |
| 4,422,190 | | 12/1983 | Huang . | |
| 4,642,820 | | 2/1987 | Boring, Jr. . | |
| 4,967,423 | | 11/1990 | Aoyama . | |
| 5,279,001 | * | 1/1994 | Vento | 4/447 |
| 5,384,919 | | 1/1995 | Smith . | |
| 5,570,479 | * | 11/1996 | Chomik et al. | 4/420.2 |

FOREIGN PATENT DOCUMENTS

| | | | | |
|---|---|---|---|---|
| 119973 | * | 10/1918 | (GB) | 4/420.5 |

* cited by examiner

*Primary Examiner*—Robert M. Fetsuga

(57) ABSTRACT

A system for adapting a toilet for use as a bidet in a manner that easily adapts to different lavatory conditions and user preferences without requiring specialized plumbing. The system for adapting a toilet for use as a bidet includes a fluid distribution apparatus for mounting on the seat of a toilet, a forward spray apparatus for mounting on the seat in fluid communication with the fluid distribution apparatus for spraying a stream of fluid in a rearward direction from the front of the seat, and a rearward spray apparatus for mounting on the seat in fluid communication with the fluid distribution apparatus for spraying a stream of fluid in a forward direction from the rear of the seat. A coupling apparatus may be provided for coupling the fluid distribution apparatus to a faucet. A base conduit on the seat may have opposite first and second openings, a nipple may be removably mountable on one of the first and second openings of the base conduit for extending from the base conduit, and a plug removably mountable in one of the first and second openings of the base conduit. The forward nozzle is positionable on a forward portion of the inner perimeter edge, and the rearward spray apparatus has a rearward nozzle positioned on a rearward portion of the inner perimeter edge.

15 Claims, 5 Drawing Sheets

SYSTEM FOR ADAPTING A TOILET FOR USE AS A BIDET

CROSS REFERENCE TO RELATED APPLICATION

This application is a substitute for Application No. 09/082,675, filed May 21, 1998.

BACKGROUND OF THE INVENTION

1. Field of the Invention

The present invention relates to bidet systems and more particularly pertains to a new system for adapting a toilet for use as a bidet in a manner that easily adapts to different lavatory conditions and user preferences without requiring specialized plumbing.

2. Description of the Prior Art

The use of bidet systems is known in the prior art. More specifically, known bidet systems, and especially those designed for adapting existing toilets for use as a bidet, have involved semi-permanent installations that hinder attempts to remove the system and install it on other toilets. The known systems typically require permanent piping connections that need modification of existing water supply piping in order to operate, and thus prevent the use of these systems by those unable to make the necessary changes to plumbing. The installation of these known systems is further complicated by the need for both hot and cold water supplies for the bidet system, since toilets are typically only supplied with cold water. Once the hot and cold water is obtained for the bidet systems, an apparatus for mixing the hot and cold water is needed to obtain a comfortable temperature of the spray water.

In these respects, the system for adapting a toilet for use as a bidet according to the present invention substantially departs from the conventional concepts and designs of the prior art, and in so doing provides an apparatus primarily developed for easily adapting to different lavatory conditions and user preferences without requiring specialized plumbing.

SUMMARY OF THE INVENTION

In view of the foregoing disadvantages inherent in the known types of bidet systems now present in the prior art, the present invention provides a new system for adapting a toilet for use as a bidet construction wherein the same can be utilized in a manner that easily adapts to different lavatory conditions and user preferences without requiring specialized plumbing.

The general purpose of the present invention, which will be described subsequently in greater detail, is to provide a new system for adapting a toilet for use as a bidet apparatus which has many of the advantages of the bidet systems mentioned heretofore and many novel features that result in a new system for adapting a toilet for use as a bidet which is not anticipated, rendered obvious, suggested, or even implied by any of the prior art bidet systems, either alone or in any combination thereof.

To attain this, the present invention generally comprises a fluid distribution apparatus for mounting on the seat of a toilet, a forward spray apparatus for mounting on the seat in fluid communication with the fluid distribution apparatus for spraying a stream of fluid in a rearward direction from the front of the seat, and a rearward spray apparatus for mounting on the seat in fluid communication with the fluid distribution apparatus for spraying a stream of fluid in a forward direction from the rear of the seat. A coupling apparatus may be provided for coupling the fluid distribution apparatus to a faucet. A base conduit on the seat may have opposite first and second openings, a nipple may be removably mountable on one of the first and second openings of the base conduit for extending from the base conduit, and a plug removably mountable in one of the first and second openings of the base conduit. The forward nozzle is positionable on a forward portion of the inner perimeter edge, and the rearward spray apparatus has a rearward nozzle positioned on a rearward portion of the inner perimeter edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new system for adapting a toilet for use as a bidet apparatus and method which has many of the advantages of the bidet systems mentioned heretofore and many novel features that result in a new system for adapting a toilet for use as a bidet which is not anticipated, rendered obvious, suggested, or even implied by any of the prior art bidet systems, either alone or in any combination thereof.

It is another object of the present invention to provide a new system for adapting a toilet for use as a bidet which may be easily and efficiently manufactured and marketed.

It is a further object of the present invention to provide a new system for adapting a toilet for use as a bidet which is of a durable and reliable construction.

An even further object of the present invention is to provide a new system for adapting a toilet for use as a bidet which is susceptible of a low cost of manufacture with regard to both materials and labor, and which accordingly is then susceptible of low prices of sale to the consuming public, thereby making such system for adapting a toilet for use as a bidet economically available to the buying public.

Still yet another object of the present invention is to provide a new system for adapting a toilet for use as a bidet which provides in the apparatuses and methods of the prior art some of the advantages thereof, while simultaneously overcoming some of the disadvantages normally associated therewith.

Still another object of the present invention is to provide a new system for adapting a toilet for use as a bidet in a manner that easily adapts to different lavatory conditions and user preferences without requiring specialized plumbing.

Yet another object of the present invention is to provide a new system for adapting a toilet for use as a bidet which includes a fluid distribution apparatus for mounting on the seat of a toilet, a forward spray apparatus for mounting on the seat in fluid communication with the fluid distribution apparatus for spraying a stream of fluid in a rearward direction from the front of the seat, and a rearward spray apparatus for mounting on the seat in fluid communication with the fluid distribution apparatus for spraying a stream of fluid in a forward direction from the rear of the seat. A coupling apparatus may be provided for coupling the fluid distribution apparatus to a faucet. A base conduit on the seat may have opposite first and second openings, a nipple may be removably mountable on one of the first and second openings of the base conduit for extending from the base conduit, and a plug removably mountable in one of the first and second openings of the base conduit. The forward nozzle is positionable on a forward portion of the inner perimeter edge, and the rearward spray apparatus has a rearward nozzle positioned on a rearward portion of the inner perimeter edge.

Still yet another object of the present invention is to provide a new system for adapting a toilet for use as a bidet that is easily installed and adapted to existing lavatory conditions without requiring plumbing modifications.

Even still another object of the present invention is to provide a new system for adapting a toilet for use as a bidet that permits simple mixing of hot and cold supply water by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
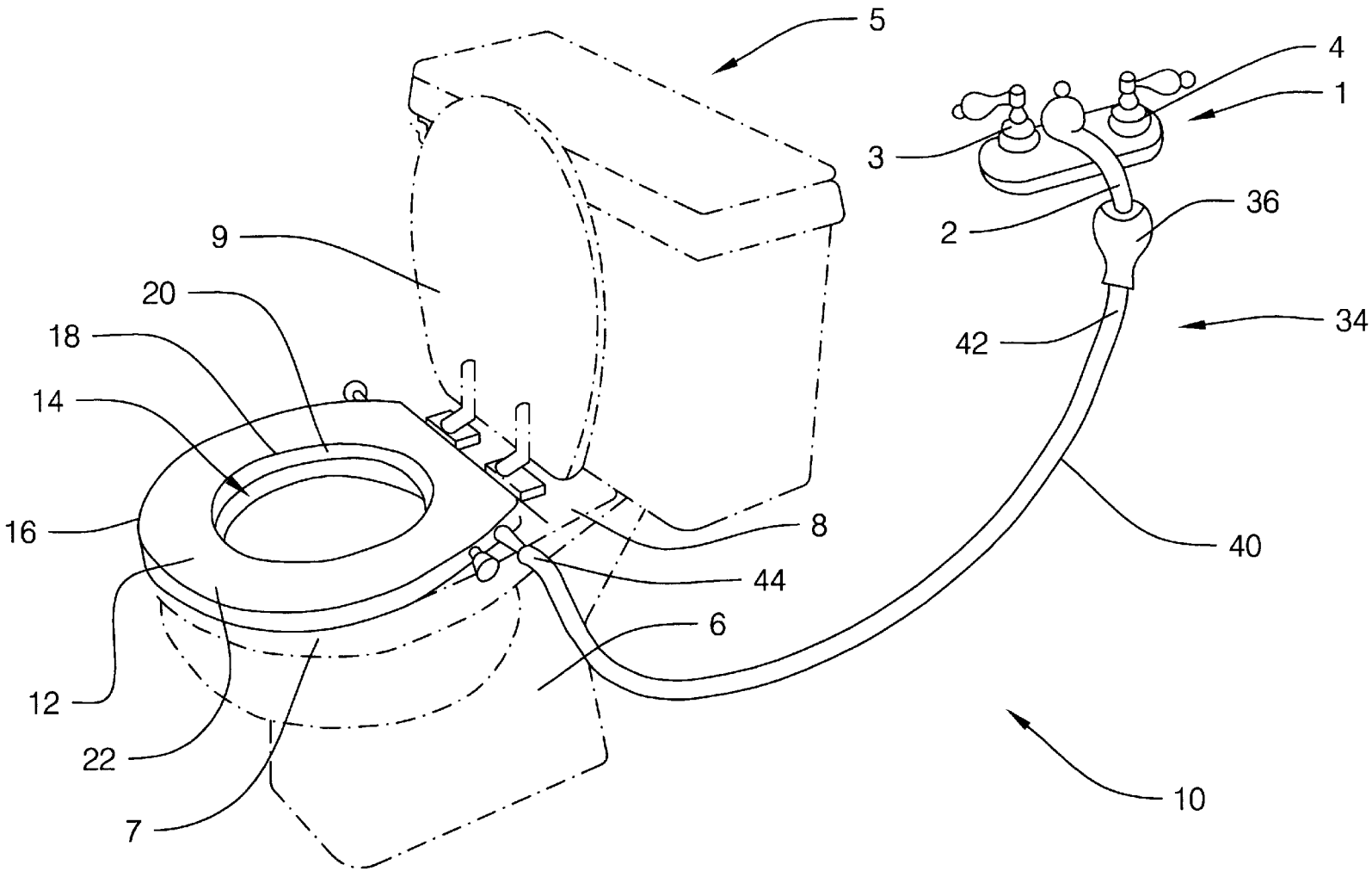
FIG. 1 is a schematic perspective view of a new system for adapting a toilet for use as a bidet according to the present invention particularly illustrating the invention mounted on a toilet and connected to a faucet.
Figure 2:
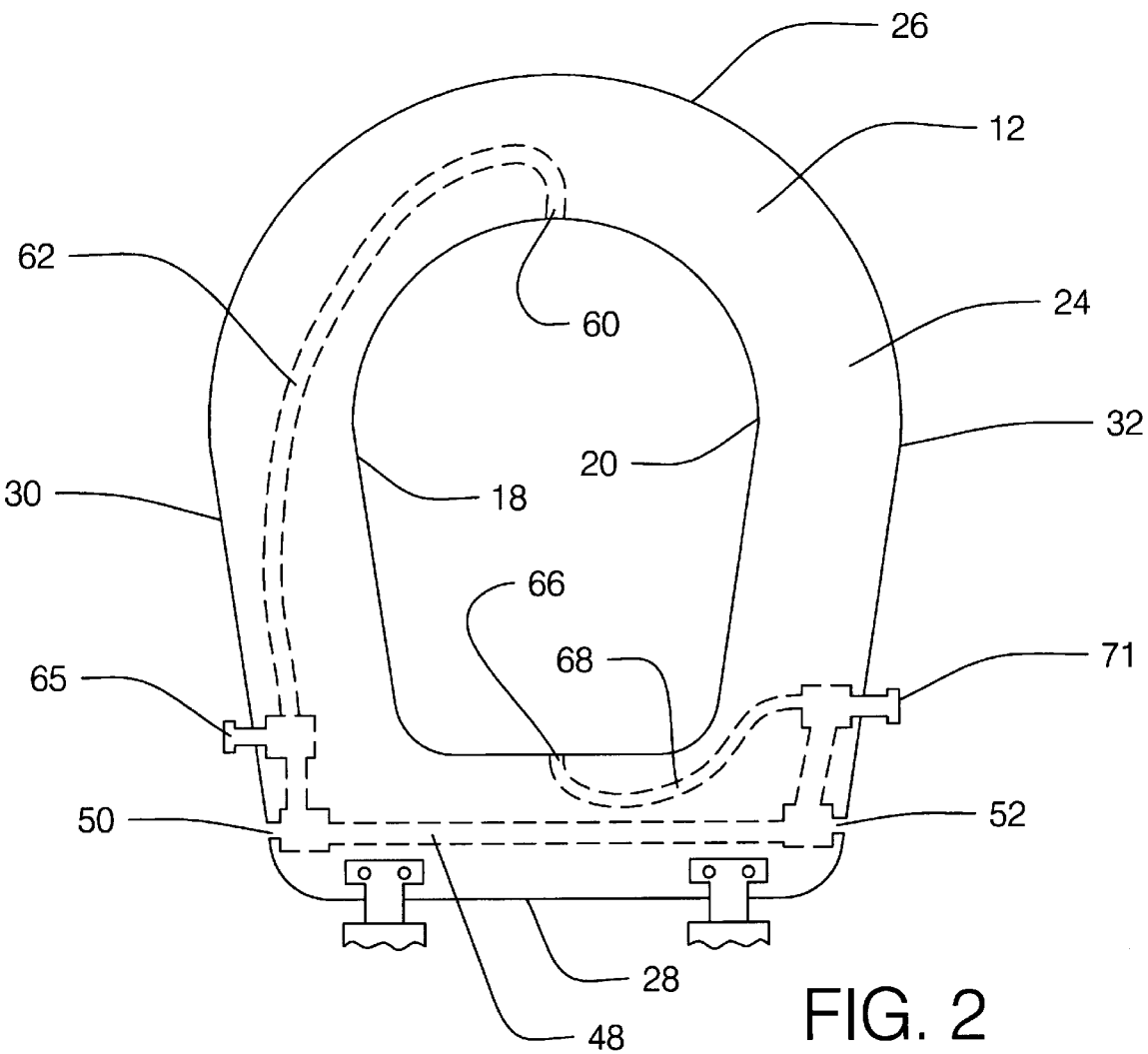
FIG. 2 is a schematic bottom view of a toilet seat particularly illustrating elements of the fluid distribution apparatus formed in the seat shown in broken lines.
Figure 3:
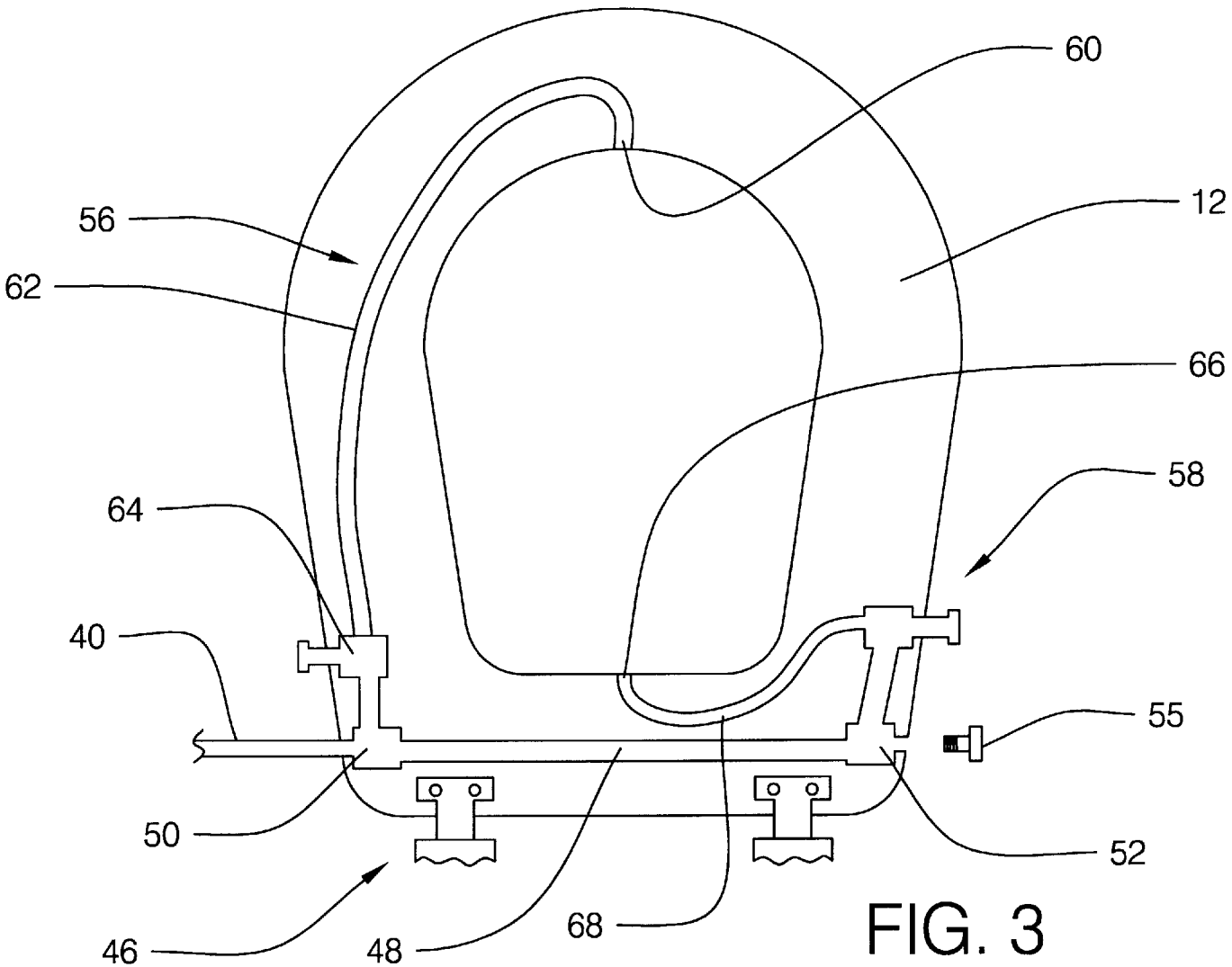
FIG. 3 is a schematic bottom view of a toilet seat particularly illustrating elements of the fluid distribution apparatus mounted on a lower surface of the seat.
Figure 4:
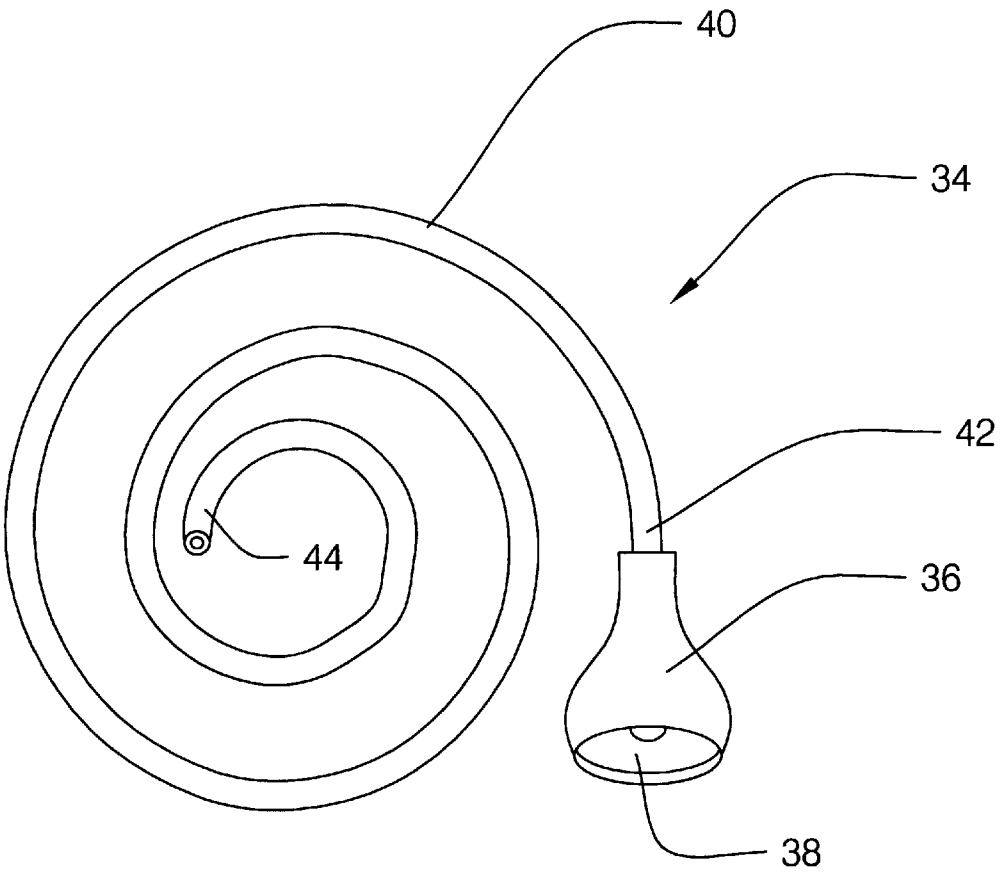
FIG. 4 is a schematic view of coupling apparatus of the present invention.
Figure 5:
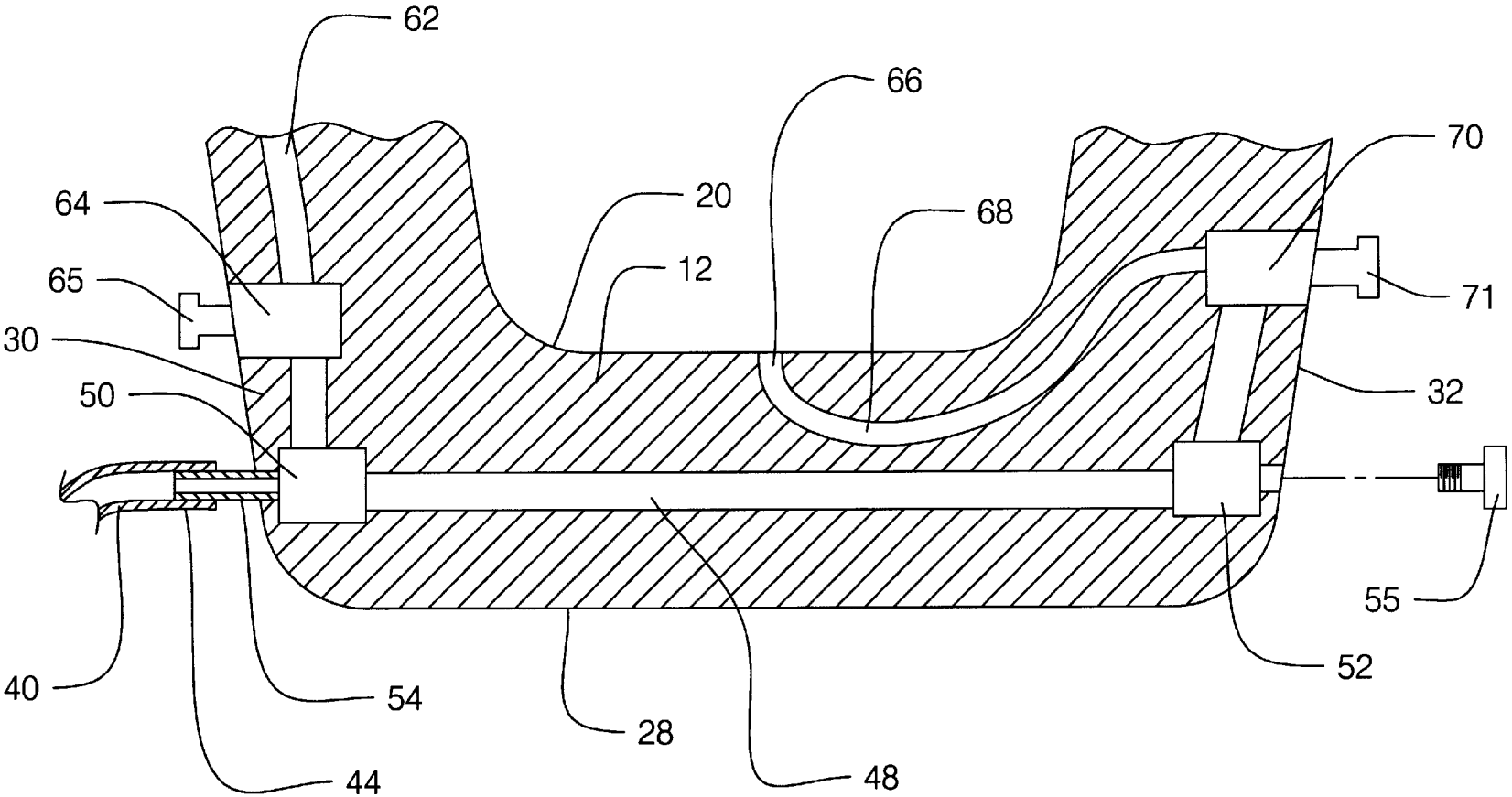
FIG. 5 is a schematic sectional view of a rear portion of a toilet seat particularly illustrating a portion of the fluid distribution apparatus of the present invention.

With reference now to the drawings, and in particular to FIGS. 1 through 5 thereof, a new system for adapting a toilet for use as a bidet embodying the principles and concepts of the present invention and generally designated by the reference numeral 10 will be described.

As best illustrated in FIGS. 1 through 5, the system 10 for adapting a toilet for use as a bidet generally comprises a The bidet system of the invention is suitable for use with a faucet 1 and a toilet 5. The system is most suitably used with a faucet 1 having a single spout 2 and a hot valve 3 for directing a selective quantity of hot water through the single spout and a cold valve 4 for directing a selective quantity of cold water through the single spout. The mixture of hot and cold water flowing as a single stream is thus controlled by the hot 3 and cold 4 valves. Optionally, a faucet having a single mixing valve and a single spout may be used.

A toilet 5 suitable for use with the invention has a tank portion and a bowl portion 6. The bowl portion 6 has a rim 7 defining an opening into the bowl portion, and the rim has an upper surface 8. A cover 9 may be pivotally mounted on the upper surface 8 of the rim 7, and the cover may have a lowered position for covering the opening and a raised position for exposing the opening.

A generally annular seat 12 is provided, and is most preferably pivotally mounted on the upper surface 8 of the rim. The seat has a central opening 14 generally aligned with the opening in the rim of the bowl portion. The seat has an outer perimeter 16 and an inner perimeter 18, with the inner perimeter defining the central opening and having an inner perimeter edge 20. The seat has an upper face 22 and a lower face 24, and the seat has a front 26 and a rear 28 and opposite lateral sides 30, 32. Preferably, the seat 12 is pivotable between a lowered position oriented adjacent to the upper surface of the rim and a raised position oriented substantially perpendicular to the upper surface of the rim.

The fluid spray system is mounted on the toilet seat. Preferably, portions of the fluid spray system are integrally formed into the toilet seat (see FIG. 2), although optionally the fluid spray system may be mounted on the lower surface of the toilet seat (see FIG. 3).

The fluid spray system preferably includes a coupling apparatus 34 for coupling to the faucet 1, such as a faucet located adjacent to the toilet. The coupling apparatus comprises a faucet coupler 36 that is adapted for coupling to the spout of a faucet. The faucet coupler has a cavity 38 for receiving a portion of a spout of a faucet therein such that a flow of water from the faucet enters the coupler. A coupling conduit 40 is also provided, and is coupled to the faucet coupler. The coupling conduit has a first end 42 in fluid communication with the cavity of the faucet coupler, and the coupling conduit has a second end 44.

The fluid spray system includes a fluid distribution apparatus 46 mounted on the seat. The fluid distribution apparatus comprises a base conduit 48 on the seat. The base conduit preferably extends between the lateral sides 30, 32 of the seat. The base conduit preferably terminates in a first opening 50 and a second opening 52, with the first opening

50 of the base conduit being located in a first one 30 of the lateral sides of the seat and the second opening 52 being located in a second one 32 of the lateral sides of the seat. The base conduit feature permits the positioning of the coupling apparatus in a manner that best suits the layout of the particular lavatory, especially the position of the faucet with respect to the toilet.

The fluid distribution apparatus 46 may also include a nipple 54 removably mountable in one of the first 50 and second 52 openings of the base conduit such that the nipple generally extends from the base conduit. The nipple 54 may be inserted in the opening that is situated relatively closest to the faucet, so that the coupling conduit is conveniently positioned without having to cross over the toilet. The second end 44 of the coupling conduit is preferably removably mountable on the nipple 54 for putting the base conduit in fluid communication with the faucet 1 when the coupling apparatus 34 is connected to the faucet.

The fluid distribution apparatus may also include a plug 55 removably mountable in one of the first and second openings of the base conduit. The plug may be inserted in the one of the first and second openings that the nipple is not inserted to prevent leakage from the base conduit, such as on the side of the seat that is furthest from the faucet location.

The fluid distribution apparatus 46 includes forward 56 and rearward 58 spray apparatus. The forward spray apparatus 56 is mounted on the seat for spraying a stream of fluid in a rearward direction from the front 26 of the seat. The forward spray apparatus has a forward nozzle 60 positioned on a forward portion of the inner perimeter edge. A forward conduit 62 is fluidly connected to the forward nozzle, and is fluidly connected to the base conduit. A forward spray valve 64 is interposed between the forward conduit and the base conduit for selectively controlling flow of fluid between the base conduit and the forward conduit for controlling fluid flow from the forward nozzle. The forward spray valve is located adjacent to a first one of the lateral sides of the seat. The forward spray valve has a forward spray actuating knob 65 extending laterally from the first lateral side of the seat for permitting manipulation of the knob by a user when the user is seated on the seat.

The rearward spray apparatus 58 is mounted on the seat for spraying a stream of fluid in a forward direction from the rear of the seat. The rearward spray apparatus has a rearward nozzle 66 positioned on a rearward portion of the inner perimeter edge. A rearward conduit 68 is fluidly connected to the rearward nozzle, and is fluidly connected to the base conduit. A rearward spray valve 70 is interposed between the rearward conduit and the base conduit for selectively controlling flow of fluid between the base conduit and the rearward conduit for controlling fluid flow from the rearward nozzle. The rearward spray valve is located adjacent to a second one of the lateral sides of the seat. The rearward spray valve has a rearward spray actuating knob 71 extending laterally from the second lateral side of the seat for permitting manipulation of the knob by a user when the user is seated on the seat.

The separate forward and rearward spray valves permit the forward and rearward sprays to be independently controlled so that one may be operated without use of the other spray.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fluid spray system for mounting on a seat of a toilet, the seat being generally annular seat with a central opening, the seat having an outer perimeter and an inner perimeter, the inner perimeter defining the central opening, the inner perimeter having an inner perimeter edge, the seat having an upper face and a lower face, the seat having a front and a rear, the seat having opposite lateral sides, the fluid spray system comprising:

a fluid distribution apparatus for mounting on the seat;

a forward spray apparatus for mounting on the seat in fluid communication with the fluid distribution apparatus for spraying a stream of fluid in a rearward direction from the front of the seat; and a rearward spray apparatus for mounting on the seat in fluid communication with the fluid distribution apparatus for spraying a stream of fluid in a forward direction from the rear of the seat;

wherein the fluid distribution apparatus comprises a base conduit mounted on the seat, the base conduit extending between the lateral sides of the seat, the base conduit terminating in a first opening and a second opening; and wherein the fluid distribution apparatus comprises a nipple being removably mountable on one of the first and second openings of the base conduit for extending from the base conduit.

2. The system of claim 1 additionally comprising a coupling apparatus for coupling the fluid distribution apparatus to a faucet.

3. The system of claim 2 wherein the coupling apparatus comprises a faucet coupler for coupling to a faucet, the faucet coupler having a cavity for receiving a portion of a spout of a faucet.

4. The system of claim 3 wherein the coupling apparatus comprises a coupling conduit coupled to the faucet coupler, the coupling conduit having a first end in fluid communication with the cavity of the faucet coupler, the coupling conduit having a second end.

5. The system of claim 1 wherein the first opening of the base conduit is located in a first one of the lateral sides of the seat and the second opening being located in a second one of the lateral sides of the seat.

6. The system of claim 1 wherein the fluid distribution apparatus comprises a plug removably mountable in one of the first and second openings of the base conduit.

7. The system of claim 1 wherein the forward spray apparatus has a forward nozzle positionable on a forward portion of the inner perimeter edge, a forward conduit fluidly connected to the forward nozzle, the forward conduit being fluidly connected to the base conduit and wherein the rearward spray apparatus has a rearward nozzle positioned on a rearward portion of the inner perimeter edge, a rearward conduit fluidly connected to the rearward nozzle, the rearward conduit being fluidly connected to the base conduit.

8. The system of claim 7 wherein the forward spray apparatus comprises a forward spray valve being interposed between the forward conduit and the base conduit for selectively controlling flow of fluid between the base conduit and the forward conduit for controlling fluid flow from the forward nozzle, a rearward spray valve being interposed between the rearward conduit and the base conduit for selectively controlling flow of fluid between the base conduit and the rearward conduit for controlling fluid flow from the rearward nozzle.

9. The system of claim 8 wherein the forward spray valve is located adjacent to a first one of the lateral sides of the seat, the forward spray valve having a forward spray actuating knob extending laterally from the first lateral side of the seat for permitting manipulation of the knob by a user when the user is seated on the seat, and wherein the rearward spray valve is located adjacent to a second one of the lateral sides of the seat, the rearward spray valve having a rearward spray actuating knob extending laterally from the second lateral side of the seat for permitting manipulation of the knob by a user when the user is seated on the seat.

10. A bidet system integrated with a toilet for use with a faucet having a single spout and a hot valve for directing a selective quantity of hot water through the single spout and a cold valve for directing a selective quantity of cold water through the single spout, comprising:

a generally annular seat being pivotally mounted on the upper surface of the rim, the seat having a central opening generally aligned with the opening in the rim, the seat having an outer perimeter and an inner perimeter, the inner perimeter defining the central opening, the inner perimeter having an inner perimeter edge, the seat having a front and a rear, the seat having opposite lateral sides;

a fluid spray system mounted on the seat, the fluid spray system comprising:

a coupling apparatus for coupling to the faucet, the coupling apparatus comprising:

a faucet coupler for coupling to a faucet, the faucet coupler having a cavity for receiving a portion of a spout of a faucet;

a coupling conduit coupled to the faucet coupler, the coupling conduit having a first end in fluid communication with the cavity of the faucet coupler, the coupling conduit having a second end;

a fluid distribution apparatus mounted on the seat, the fluid distribution apparatus comprising:

a base conduit integrally formed in the seat, the base conduit extending between the lateral sides of the seat, the base conduit terminating in a first opening and a second opening end, the first opening of the base conduit being located in a first one of the lateral sides of the seat and the second opening being located in a second one of the lateral sides of the seat;

a nipple removably mountable in one of the first and second openings of the base conduit for extending from the base conduit, the second end of the coupling conduit being removably mountable on the second end of the coupling conduit;

a forward spray apparatus mounted on the seat for spraying a stream of fluid in a rearward direction from the front of the seat; and a rearward spray apparatus mounted on the seat for spraying a stream of fluid in a forward direction from the rear of the seat.

11. The system of claim 10 wherein the fluid distribution apparatus comprises a plug removably mountable in one of the first and second openings of the base conduit.

12. The system of claim 10 wherein the forward spray apparatus has a forward nozzle positionable on a forward portion of the inner perimeter edge, a forward conduit fluidly connected to the forward nozzle, the forward conduit being fluidly connected to the base conduit, and wherein the rearward spray apparatus has a rearward nozzle positioned on a rearward portion of the inner perimeter edge, a rearward conduit fluidly connected to the rearward nozzle, the rearward conduit being fluidly connected to the base conduit.

13. The system of claim 12 wherein the forward spray apparatus comprises a forward spray valve being interposed between the forward conduit and the base conduit for selectively controlling flow of fluid between the base conduit and the forward conduit for controlling fluid flow from the forward nozzle, a rearward spray valve being interposed between the rearward conduit and the base conduit for selectively controlling flow of fluid between the base conduit and the rearward conduit for controlling fluid flow from the rearward nozzle.

14. The system of claim 12 wherein the forward spray valve is located adjacent to a first one of the lateral sides of the seat, the forward spray valve having a forward spray actuating knob extending laterally from the first lateral side of the seat for permitting manipulation of the knob by a user when the user is seated on the seat, and wherein the rearward spray valve is located adjacent to a second one of the lateral sides of the seat, the rearward spray valve having a rearward spray actuating knob extending laterally from the second lateral side of the seat for permitting manipulation of the knob by a user when the user is seated on the seat.

15. A bidet system integrated with a toilet for use with a faucet having a single spout and a hot valve for directing a selective quantity of hot water through the single spout and a cold valve for directing a selective quantity of cold water through the single spout, comprising:

a toilet having a tank portion and a bowl portion, the bowl portion having a rim defining an opening into the bowl portion, the rim having an upper surface, a cover being pivotally mounted on the upper surface of the rim and having a lowered position for covering the opening and a raised position for exposing the opening;

a generally annular seat being pivotally mounted on the upper surface of the rim, the seat having a central opening generally aligned with the opening in the rim, the seat having an outer perimeter and an inner perimeter, the inner perimeter defining the central opening, the inner perimeter having an inner perimeter edge, the seat having an upper face and a lower face, the seat having a front and a rear, the seat having opposite lateral sides, the seat being pivotable between a lowered position oriented adjacent to the upper surface of the rim and a raised position oriented substantially perpendicular to the upper surface of the rim;

a fluid spray system mounted on the seat, the fluid spray system comprising:

a coupling apparatus for coupling to the faucet, the coupling apparatus comprising:

a faucet coupler for coupling to a faucet, the faucet coupler having a cavity for receiving a portion of a spout of a faucet;

a coupling conduit coupled to the faucet coupler, the coupling conduit having a first end in fluid communication with the cavity of the faucet coupler, the coupling conduit having a second end;

a fluid distribution apparatus mounted on the seat, the fluid distribution apparatus comprising:

a base conduit on the seat, the base conduit extending between the lateral sides of the seat, the base conduit terminating in a first opening and a second opening end, the first opening of the base conduit being located in a first one of the lateral sides of the seat and the second opening being located in a second one of the lateral sides of the seat;

a nipple removably mountable in one of the first and second openings of the base conduit for extending from the base conduit, the second end of the coupling conduit being removably mountable on the second end of the coupling conduit;

a plug removably mountable in one of the first and second openings of the base conduit;

a forward spray apparatus mounted on the seat for spraying a stream of fluid in a rearward direction from the front of the seat, the forward spray apparatus having a forward nozzle positioned on a forward portion of the inner perimeter edge, a forward conduit fluidly connected to the forward nozzle, the forward conduit being fluidly connected to the base conduit, a forward spray valve being interposed between the forward conduit and the base conduit for selectively controlling flow of fluid between the base conduit and the forward conduit for controlling fluid flow from the forward nozzle, the forward spray valve being located adjacent to a first one of the lateral sides of the seat, the forward spray valve having a forward spray actuating knob extending laterally from the first lateral side of the seat for permitting manipulation of the knob by a user when the user is seated on the seat;

a rearward spray apparatus mounted on the seat for spraying a stream of fluid in a forward direction from the rear of the seat, the rearward spray apparatus having a rearward nozzle positioned on a rearward portion of the inner perimeter edge, a rearward conduit fluidly connected to the rearward nozzle, the rearward conduit being fluidly connected to the base conduit, a rearward spray valve being interposed between the rearward conduit and the base conduit for selectively controlling flow of fluid between the base conduit and the rearward conduit for controlling fluid flow from the rearward nozzle, the rearward spray valve being located adjacent to a second one of the lateral sides of the seat, the rearward spray valve having a rearward spray actuating knob extending laterally from the second lateral side of the seat for permitting manipulation of the knob by a user when the user is seated on the seat.

* * * * *